United States Patent [19]

Witczak

[11] Patent Number: 4,759,286

[45] Date of Patent: Jul. 26, 1988

[54] MOUNTING BRACKET FOR PRINTING OR DUPLICATING MACHINE ROLLER

[75] Inventor: Stanley Witczak, Chicago, Ill.

[73] Assignee: AM International, Inc., Chicago, Ill.

[21] Appl. No.: 54,634

[22] Filed: May 27, 1987

[51] Int. Cl.[4] ..... B41F 13/20

[52] U.S. Cl. ..... 101/216; 101/349; 400/660.2

[58] Field of Search ..... 101/216, DIG. 10, 348, 101/349, 350, 148, 247, 352; 24/590; 411/349, 549, 550, 552, 553; 403/323, 324, 327; 400/660.2

[56] References Cited

U.S. PATENT DOCUMENTS 4,119,032 10/1978 Hollis ..... 101/216
4,676,678 6/1987 Watanabe ..... 400/660.2

FOREIGN PATENT DOCUMENTS 723007 2/1955 United Kingdom ..... 101/348
1601603 11/1981 United Kingdom ..... 101/348

*Primary Examiner*—Edgar S. Burr
*Assistant Examiner*—James Lisehora
*Attorney, Agent, or Firm*—Nicholas A. Camasto; John R. Hoffman

[57] ABSTRACT

A bracket assembly for receiving the shaft end of a distribution roller in a printing, duplicating or like machine. A pin head structure is mounted on a framework of the machine. The pin head structure includes an axially inwardly facing abutment surface against which the shaft end of the roller can abut when in proper position in the machine. A latch member is movably mounted on the pin head structure for radially containing the roller in its proper position and for allowing removal of the roller in the radial direction. The latch member is movable from a first position disposed axially outwardly of the abutment surface to permit the roller to be radially moved into and out of its proper position in the machine, and a second position disposed axially inwardly of the abutment surface overlying the shaft end to contain the roller in its proper position in the machine.

17 Claims, 1 Drawing Sheet

MOUNTING BRACKET FOR PRINTING OR DUPLICATING MACHINE ROLLER

BACKGROUND OF THE INVENTION

This invention generally relates to printing or duplicating machines and, more particularly, to a bracket assembly for receiving and positionally adjusting the shaft end of a form roller in the printing couple of the machine.

Printing machines normally include a printing couple which comprises a number of cylinders and/or rollers such as impression cylinders, master cylinders, blanket cylinders, ductor rollers, transfer rollers, regulator rollers, and the like. For instance, an ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine.

The distribution rollers conventionally are mounted between spaced side frame plates of the machine framework. Many of the rollers are arranged in triangular arrays, and the rollers define distribution gaps with other adjacent rollers to form flow paths for the ink and/or moisture to the master or plate cylinder. Throughout the complex system of rollers, the "gaps" or pressure between adjacent rollers must be capable of regulation or positional adjustment in order to regulate the flow of ink or moisture through the flow paths of the roller system to the printing couple. The position of the rollers are critical in order to avoid lines or "shadows" on the imaged copy which are caused by uneven distribution of the ink or moisture. For instance, any "play" between the distribution rollers adversely affects the maintenance of proper ink gaps and results in poor copy quality.

Heretofore, roller mounting and adjustment mechanisms have been extremely complicated. Often, the machine must be shut down in order to perform any adjustments. In some instances, one or more of the rollers may have to be removed in order to accomplish any adjustments. This further complicates the construction of the mounting assemblies or brackets for the form rollers. These problems further are complicated in machines where it may be necessary to separate one or more rollers during down time.

It would be desirable to provide simple, effective and easy to adjust bracket assemblies for positioning the transfer or "distribution" rollers in a manner to permit rapid and easy loading and removal of the rollers as well as to provide for axial adjustment of the rollers to take up any axial play between the roller shaft end and the mounting bracket.

SUMMARY OF THE INVENTION

An object, therefore, of the invention is to provide a new and improved bracket assembly for mounting a transfer roller in a printing, duplicating or like machine.

Another object of the invention is to provide a bracket assembly of the character described which provides for easy loading and removal of the transfer roller in the machine, while providing for axial adjustment of the roller.

In the exemplary embodiment of the invention, a bracket assembly is provided for receiving the axial shaft end of a transfer or distribution roller in a printing, duplicating or like machine. A pin head structure is mounted on a framework of the machine and includes axially facing abutment surface means against which the shaft end of the roller can abut when in proper position in the machine. Generally, radial containment means are movably mounted on the pin head structure for radially containing the distribution roller in its proper position and for allowing ready removal of the roller in a radial direction from the machine. The radial containment means include a latch member movable from a first position disposed axially removed behind the abutment surface means to permit the roller to be radially moved into its proper position in the machine, and a second position diposed axially inwardly of the abutment surface means overlying the shaft end to contain the roller in its proper position in the machine.

Preferably, the latch member is spring loaded to hold the latch member in either of the aforesaid first or second positions. In other words, the spring holds the latch member in the first position and biases the latch member in a radial direction against the shaft end when the latch member is in the second, containing position.

Another feature of the invention is the provision of pin means axially movably mounted in the surface abutment means of the pin head structure for adjustment axially against the shaft end of the roller. Means are provided for holding the pin means in any axial position of adjustment. This takes up any axial play between the roller shaft end and the bracket and, thus, the machine itself.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
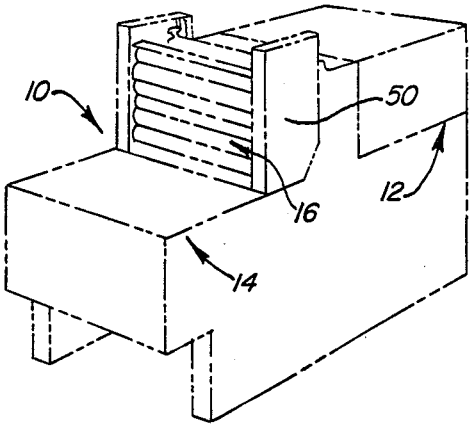
FIG. 1 is a somewhat schematic perspective view of a printing or duplicating machine in which the invention is applicable.

Referring to the drawings in greater detail, and first to FIG. 1, the invention is illustrated herein for use in a printing, duplicating or like machine, generally designated 10, which includes a sheet feeding end, generally designated 12, and an imaged copy exiting end, generally designated 14. The copy sheets which have images produced on one or both sides are stacked at exiting end 14 as is conventional with most printing or duplicating machines. The machine includes at least one printing couple, generally designated 16, which includes the conventional impression cylinders, blanket cylinders and master or plate cylinders. Usually, the printing couple includes one impression cylinder, one blanket cylinder and one master or plate cylinder.

Printing or duplicating machine 10 may be such as a rotary offset lithographic machine which includes an ink fountain for feeding ink to various distribution rollers of the printing couple which transfers images to copy sheets. In addition, a moisture fountain is disposed adjacent the printing couple for feeding moisture to the printing couple through a path defined by the distribution rollers.

Figure 2:
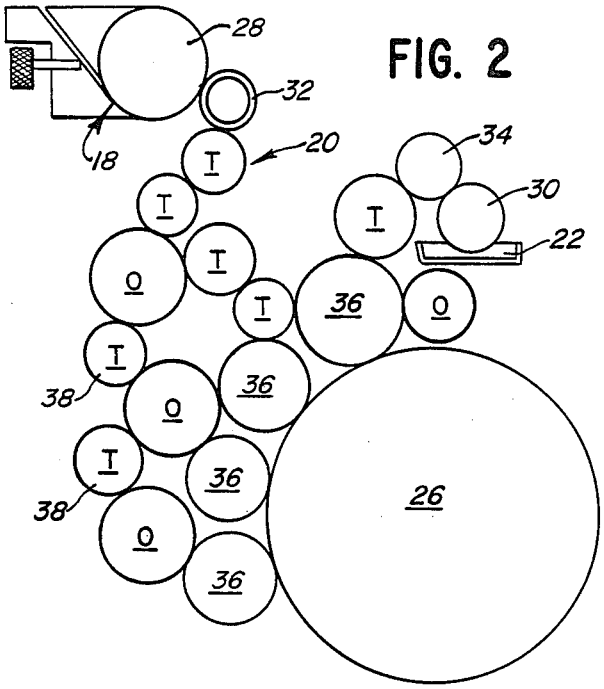
FIG. 2 is a somewhat schematic view of the rollers comprising the system for feeding ink and moisture to the master cylinder of the machine.

More particularly, FIG. 2 illustrates the ink/moisture roller system of the machine for distributing ink from an ink fountain, generally designated 18, through an ink feeding roller system, generally designated 20, and for feeding moisture from a moisture fountain 22 through a moisture feeding roller system, generally designated 24, to a master or plate cylinder 26. An ink fountain roller 28 is rotatable in ink fountain 18, and a moisture roller 30 is rotatable in moisture fountain 22. Pickup rollers 32 and 34 are provided in rolling contact with ink fountain roller 28 and moisture fountain roller 30, respectively.

The ink/moisture distribution system for distributing ink and moisture to master cylinder 26 includes four form rollers 36 in rolling contact with master cylinder 26. A number of transfer rollers and oscillating rollers are provided in the distribution system and, for brevity purposes, have been designated "T" and "O", respectively.

The bracket assembly of this invention is designed for positioning and axially adjusting the shaft ends of one or more of the rollers in the ink/moisture distribution system described above. The bracket assemblies are particularly applicable for positioning and containing the transfer rollers "T". However, it should be understood that the bracket assembly of this invention is applicable for mounting a variety of different rollers having different functions and locations and, consequently, in the following description and the claims, the general term "distribution" roller will be used at times in conjunction with the description of the bracket assembly.

Figure 3:
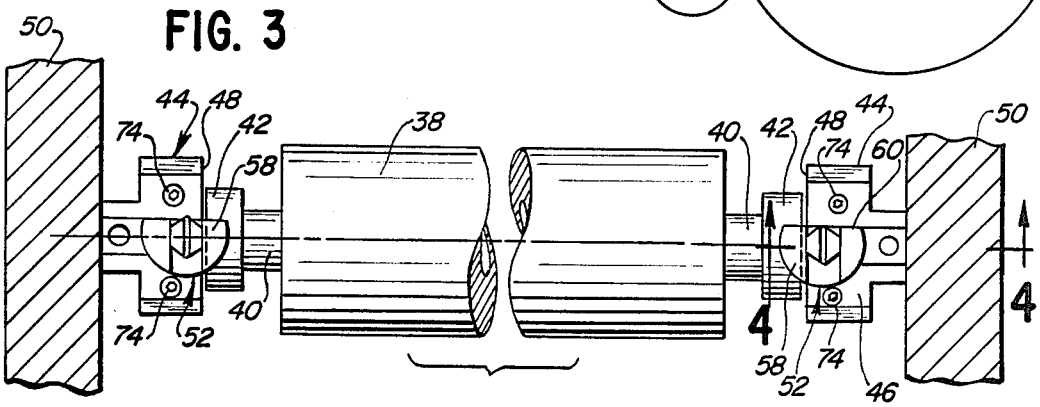
FIG. 3 is a fragmented elevational view of a transfer roller with the shaft ends thereof mounted by bracket assemblies of this invention.

FIG. 3 shows a distribution roller 38 (also see FIG. 2) having shaft ends 40 provided with bearings 42. The shaft ends are received or positioned by means of bracket assemblies, generally designated 44, designed in accordance with the concepts of the invention. Each bracket assembly includes a pin head structure 46 in the form of a substantially solid metal block having an axially inwardly facing abutment surface 48. The block is mounted directly to the inside surface of a side frame plate 50 of the printing or duplicating machine. It can be seen in FIG. 3 that identical mounting brackets 44 are mounted to spaced frame plates 50 of the machine, at opposite ends of roller 38 for positioning shaft ends 40.

It also should be understood that throughout the remainder of this specification and the claims herein, the term "shaft end(s)" is being used when in fact, as shown, the components of the bracket assemblies actually engage bearings 42 disposed at the distal ends of the shaft ends.

Figure 4:
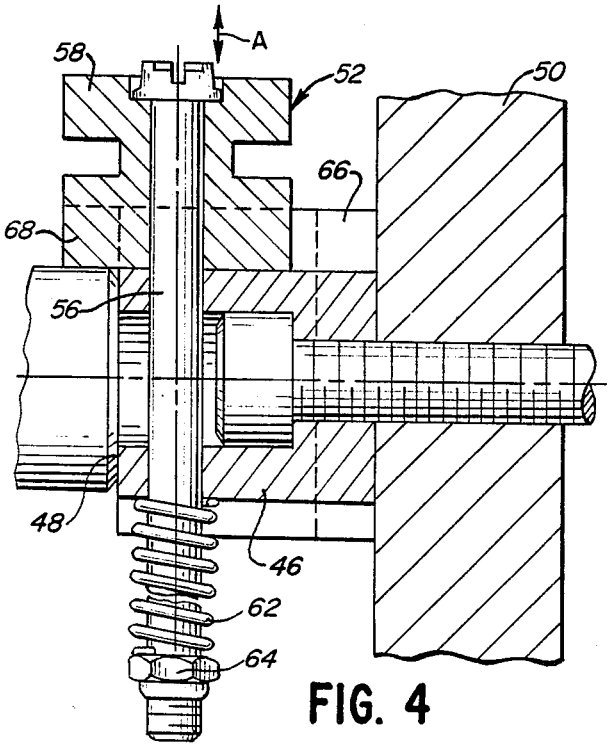
FIG. 4 is an axial section, on an enlarged scale, taken generally along line 4—4 of FIG. 3, through the bracket assembly illustrating the pin latch member in its containing position.
Figure 5:
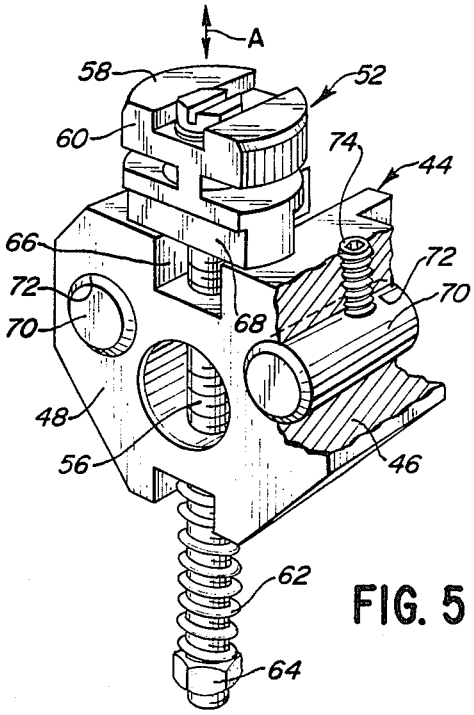
FIG. 5 is a perspective view illustrating the pin latch member in its position to allow removal of the roller.

FIGS. 4 and 5, in conjunction with FIG. 3, illustrate the details of each bracket assembly 44. Generally, radial containment means are movably mounted on pin head structure 46 of each bracket assembly for radially containing the distribution roller in its proper position in the machine and for allowing removal of the roller in a radial direction out of the machine.

The radial containment means include a latch member, generally designated 52, which, as described in greater detail hereinafter, is movable from a first position disposed axially outwardly of or removed behind abutment surface 48 (FIG. 5) to permit roller 38 to be radially moved into its proper position in the machine. Latch member 52 is movable to a second position disposed axially inwardly of abutment surface 48 (FIG. 4) overlying the respective bearing 42 on the respective shaft end 40 to contain the roller in its proper position in the machine. It should be understood that "containment" actually means holding the transfer roller(s) 38, as seen in FIG. 2, against the adjacent oscillating rollers "O". In other words, the containment actually is unidirectional because the oscillating rollers provide reaction resistance in the opposite direction. Latch member 52 holds the transfer rollers in their proper positions in the machine against the oscillating rollers.

More particularly, as seen best in FIGS. 4 and 5, latch member 52 includes a pin 56 having an enlarged pin head 58. The enlarged pin head has a recessed side 60. Pin 56 protrudes completely through pin head structure or block 46 and is spring loaded by a coil spring 62 sandwiched between the block and a nut 64 threaded onto the distal end of pin 56, i.e. the end opposite enlarged head 58. Therefore, pin 56 and pin head 58 can move both rotationally about the axis of the pin as well as longitudinally lengthwise of the pin in the direction of double-headed arrow "A" relative to pin head structure 46.

Interlocking means are provided between enlarged pin head 58 and pin head structure 46 to lock the pin head in its position overlying shaft end bearing 42, as seen in FIG. 4. Specifically, pin head structure 46 has a slot 66 formed beneath the pin head for receiving a complementarily shaped, elongated tongue 68. The tongue is elongated greater than the width of slot 66 whereby the tongue will seat in the slot, under the biasing of spring 62, whereupon the pin and pin head cannot rotate when the latch member 52 is in the position of FIG. 4 containing the roller in its proper position in the machine.

When it is desirable or necessary to remove the roller, pin head 58 is grasped by an operator and lifted in the direction of arrow "A" (FIG. 4), pulling tongue 68 out of slot 66 whereupon the pin head can be rotated. Upon rotation, recessed side 60 of the pin head can be aligned to be flush with abutment surface 48 of pin head block 46 whereupon the roller bearing 42 can be moved past the pin head to easily remove the entire roller from the machine. This position of pin 56 and pin head 58 (i.e. latch member 52) is shown in FIG. 5. Coil spring 62 is effective to exert sufficient pressure on the underside of pin head 58 against pin head structure 46 to hold the pin head in this position until the roller is replaced.

Another feature of the invention includes a pair of cylindrical pins 70 (FIG. 5) which are freely mounted within bores 72 axially through pin head structure 46. Pins 70 are located radially so as to be in alignment with bearing 42 at the adjacent shaft end of the roller. Set screws 74 are threaded through pin head structure 46 for engagement against pins 70. Therefore, by loosening set screws 74, pins 70 can be moved axially into abutment with the roller bearing 42 to take up any axial play between the roller shaft end and the bracket and, in turn, the machine side plates 50. Tightening of the set screws rigidly hold the pins in their positions of adjustment whereupon the roller can be properly axially adjusted in the machine without any axial "play" in the roller.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A bracket assembly for receiving the axial shaft end of a distribution roller in a printing, duplicating or like machine, comprising:

a pin head structure mounted on a framework of the machine and including axially inwardly facing abutment surface means against which the shaft end of the distribution roller can abut when in proper position in the machine; and radial containment means movably mounted on the pin head structure for radially containing the distribution roller in said position and for allowing removal of the roller in a radial direction, including a latch member movable from a first position disposed axially outwardly of said abutment surface means to permit the roller to be radially moved into and out of its proper position in the machine and a second position disposed axially inwardly of said abutment surface means overlying said shaft end to contain the roller in its proper position in the machine.

2. The bracket assembly of claim 1, including spring means loading said latch member to bias the latch member in a radial direction against the shaft end when the latch member is in said second, containing position.

3. The bracket assembly of claim 1, including spring means loading said latch member to hold the latch member in said first position.

4. The bracket assembly of claim 1, including spring means loading said latch member to hold the latch member in either of said first or second positions.

5. The bracket assembly of claim 1 wherein said latch member comprises a pin, including an enlarged pin head with a recessed side, rotatably mounted in the pin head structure whereby the enlarged pin head projects axially inwardly of said abutment surface means overlying the shaft end in one position of rotation, and the recessed side of the pin head is disposed at least flush with the abutment surface means in another position of rotation to permit the roller to be radially moved into its proper position in the machine.

6. The bracket assembly of claim 5, including interlocking means between said enlarged pin head and the pin head structure to lock the pin head in said another position of rotation

7. The bracket assembly of claim 6, including spring means loading said pin and pin head to hold the pin head in its locked condition.

8. The bracket assembly of claim 5 wherein said pin is reciprocally mounted lengthwise in the pin head structure, and including spring means loading the pin to bias the pin head in a radial direction against the shaft end when the pin head is in said one position of rotation.

9. The bracket assembly of claim 8, including pin means axially movably mounted in said surface abutment means of the pin head strtucture for adjustment axially against the shaft end of the roller to take up any axial play between the roller shaft end and the bracket, and means for holding the pin means in an axial position of adjustment.

10. A bracket assembly for receiving the axial shaft end of a distribution roller in a printing, duplicating or like machine, comprising:

a pin head structure mounted on a framework of the machine and including axially inwardly facing abutment surface means against which the shaft end of the distribution roller can abut when in proper position in the machine; and radial containment means movably mounted on the pin head structure for radially containing the distribution roller in said position and for allowing removal of the roller in a radial direction, said radial containment means being movable from a first position disposed axially outwardly of said abutment surface means to permit the roller to be radially moved into and out of its proper position in the machine and a second position disposed axially inwardly of said abutment surface means overlying said shaft end to contain the roller in its proper position in the machine.

11. The bracket assembly of claim 10, including spring means loading said radial containment means to bias the radial containment means in a radial direction against the shaft end when the radial containment means is in said second, containing position.

12. The bracket assembly of claim 10, including spring means loading said radial containment means to hold the radial containment means in said first position.

13. The bracket assembly of claim 10, including spring means loading said radial containment means to hold the radial containment means in either of said first or second positions.

14. A bracket assembly for receiving the axial shaft end of a distribution roller in a printing, duplicating or like machine, comprising:

a pin head structure mounted on a framework of the machine and including axially inwardly facing abutment surface means against which the shaft end of the distribution roller can abut when in proper position in the machine; and a latch member rotatably mounted on said pin head structure for rotational movement to a first position disposed axially outwardly of said abutment surface means to permit the roller to be radially moved into and out of its proper position in the machine and a second position disposed axially inwardly of said abutment surface means overlying said shaft end to contain the roller in its proper position in the machine.

15. The bracket assembly of claim 14, including spring means loading said latch member to bias the latch member in a radial direction against the shaft end when the latch member is in said second, containing position.

16. The bracket assembly of claim 14, including spring means loading said latch member to hold the latch member in said first position.

17. The bracket assembly of claim 14, including spring means loading said latch member to hold the latch member in either of said first or second positions.

* * * * *